US006994590B2

(12) United States Patent
Nishida

(10) Patent No.: US 6,994,590 B2
(45) Date of Patent: Feb. 7, 2006

(54) WATERPROOF CONNECTOR

(75) Inventor: Shiro Nishida, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 139 days.

(21) Appl. No.: 10/724,917

(22) Filed: Dec. 1, 2003

(65) Prior Publication Data

US 2004/0110419 A1 Jun. 10, 2004

(30) Foreign Application Priority Data

Feb. 12, 2002 (JP) ..... 2002-350205

(51) Int. Cl.
*H01R 13/40* (2006.01)

(52) U.S. Cl. ..... 439/587; 439/271

(58) Field of Classification Search ..... 439/587–589, 439/271–272

See application file for complete search history.

(56) References Cited

U.S. PATENT DOCUMENTS 5,622,512 A * 4/1997 Uchida et al. ..... 439/271
5,997,349 A 12/1999 Yoshioka
6,354,958 B1 3/2002 Meyer
6,398,585 B1 * 6/2002 Fukuda ..... 439/587
6,528,727 B2 3/2003 Miyazaki

FOREIGN PATENT DOCUMENTS

JP 5-17957 3/1993
JP 2002-75543 3/2002

* cited by examiner

*Primary Examiner*—Truc Nguyen
(74) *Attorney, Agent, or Firm*—Gerald E. Hespos; Anthony J. Cassella

(57) ABSTRACT

A female connector (10) accommodating a female terminal fitting (17) has a sealing member (26) displaying a function of sealing the gap between a female connector housing (11) of the female connector (10) and a male connector housing (31) of a male connector (30). The sealing member (26) has a sealing part (27) made of a rubber material; and a rear part 28, made of a highly rigid synthetic resinous material, fixed to the sealing part (27). The rear part (28) has a locking portion (28*a*) which engages an engaging hole (14*a*) of the female connector housing (11); and a reinforcing portion (28*b*), fixed to an entire periphery of a rear end of the sealing part (27) formed integrally with the locking portion (28*a*). The sealing part (27) and the rear part (28) are fixed to each other by using a two-color molding method.

12 Claims, 8 Drawing Sheets

WATERPROOF CONNECTOR

BACKGROUND OF THE INVENTION

1. Field of the Invention

The present invention relates to a waterproof connector.

2. Description of the Related Art

Japanese Patent Application Laid-Open No. 2002-75543 discloses a waterproof shielding connector for connecting a motor cable of an electric car. The waterproof connector has male and female housings that are connectable to one another. A seal ring composed of a sealing part mounted on a female housing for sealing a gap between the female and male housings. The seal ring also has a locking claw formed integrally with the sealing part and locked to an engaging hole of the female housing.

The waterproof connector disclosed in Japanese Patent Application Laid-Open No. 2002-75543 requires the connection end of the shielding electric wire to be shielded near where the housings are fit together. Thus, the housings may be formed from a die cast aluminum. The seal ring generally is formed unitarily from rubber to provide good sealing. The housing cast from aluminum has a certain relative roughness. Accordingly the rubber sticks to the mating male housing and is pulled by the rough aluminum when the housings are disconnected from each other. As a result, the locking claw locked to the engaging hole of the female connector housing is expanded or broken. Consequently there is a possibility that the seal ring will slip out of place and drop from the female housing.

The present invention has been made in view of the above-described problem. Accordingly, it is an object of the invention to provide a waterproof connector having a sealing member that is not expanded or broken and is capable of preventing a sealing part from slipping off a connector housing thereof while sealing the gap between the waterproof housing and a mating housing made of a rough or stickable material.

SUMMARY OF THE INVENTION

The invention relates to a waterproof connector with a sealing part mounted on a housing and held elastically between the housing and a housing of a mating connector for displaying a sealing function. At least one lock is connected to the sealing part. The lock is secured to an engaging hole on the housing to prevent the sealing part from slipping off the housing.

The lock preferably is made of a highly rigid material. Thus, the lock is not expanded or broken even if the sealing part sticks to the mating housing while the connectors are being unlocked from each other. Therefore, the sealing part will not slip out of place or drop from the housing.

A reinforcing portion preferably is formed integrally with the lock at least at both circumferential sides of the lock. Therefore, the housing holds the sealing part that is fixed to the reinforcing portion. Accordingly, the sealing part is not likely to slip off the housing, even if a high pulling force is applied to the sealing part.

The reinforcing portion preferably is made of the same material as the lock and is fixed to the sealing part. The reinforcing portion preferably is fixed to an entire periphery of a rear end of the sealing part. Thus, the housing holds the entire periphery of the sealing part. Therefore, the sealing part is not likely to slip off the housing, even if a high pulling force is applied thereto. Additionally, a molding die for the sealing member has a comparatively simple construction and can be produced easily.

The lock preferably is fixed to the sealing part by using a two-color molding method. Thus, it is possible to produce the sealing part in one molding process and it is unnecessary to use a process of bonding the rubber and the highly rigid material to each other. Accordingly, the sealing member can be manufactured at a low cost.

DETAILED DESCRIPTION OF THE PREFERRED EMBODIMENTS

Figure 1:
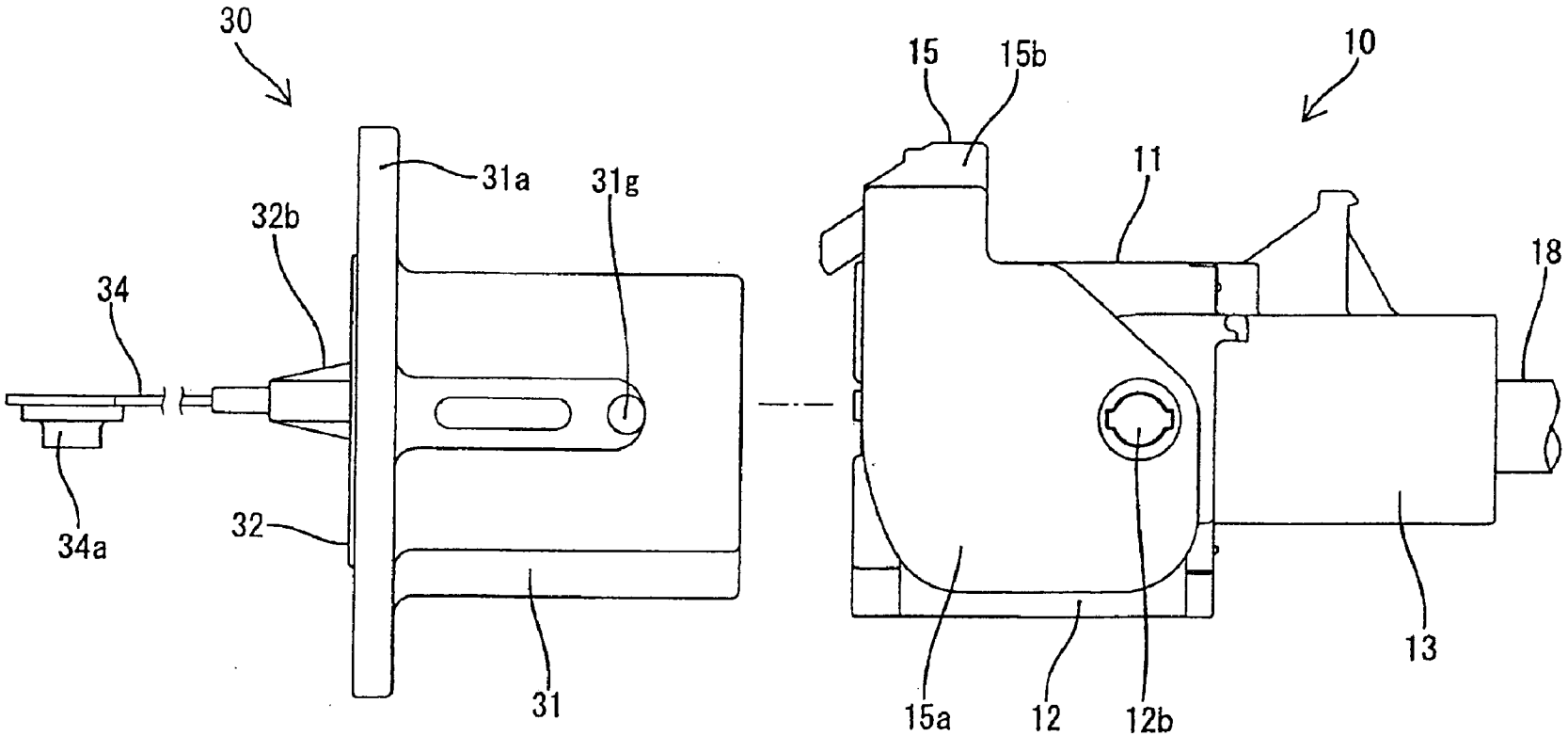
FIG. 1 is a side view showing a waterproof connector and a mating connector according to a first embodiment of the present invention.

A shielding connector apparatus according to a first embodiment of the invention is illustrated in FIGS. 1 through 7. The shielding connector apparatus includes a female connector 10 and a mating male connector 30 that are connected with a motor cable of an electric car. The female connector 10 includes a female housing 11 with an outer housing 12 and an inner housing 13 in the outer housing 12.

Figure 2:
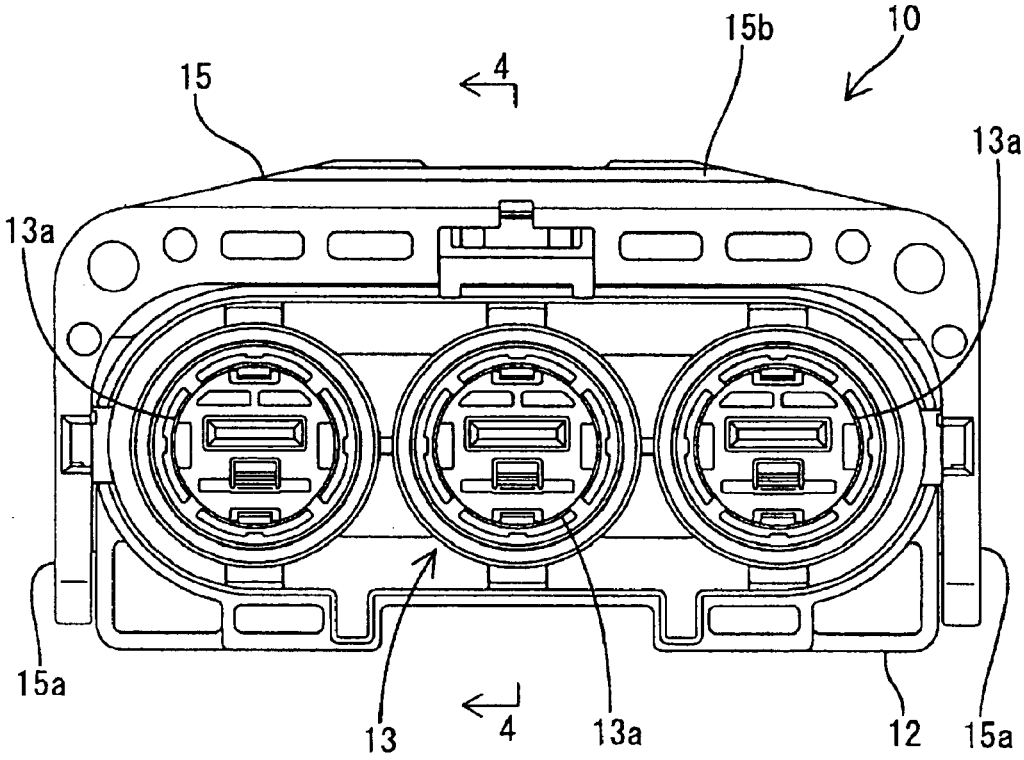
FIG. 2 is a front view showing the waterproof connector.
Figure 3:
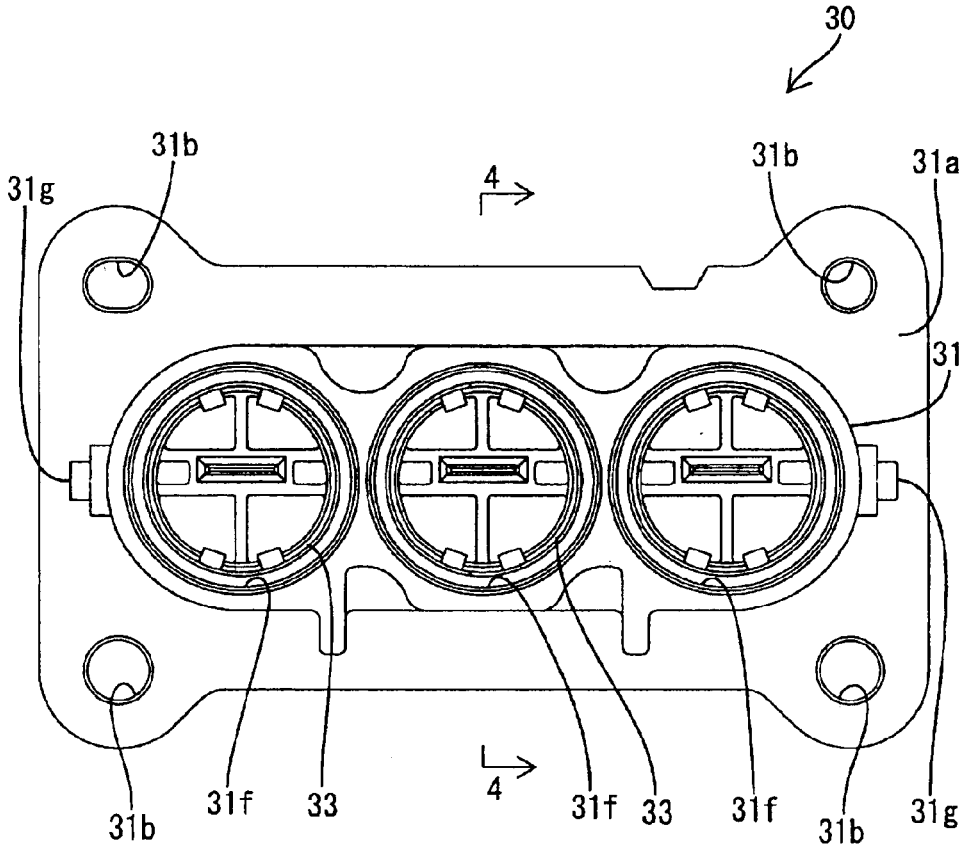
FIG. 3 is a front view showing the mating connector.
Figure 4:
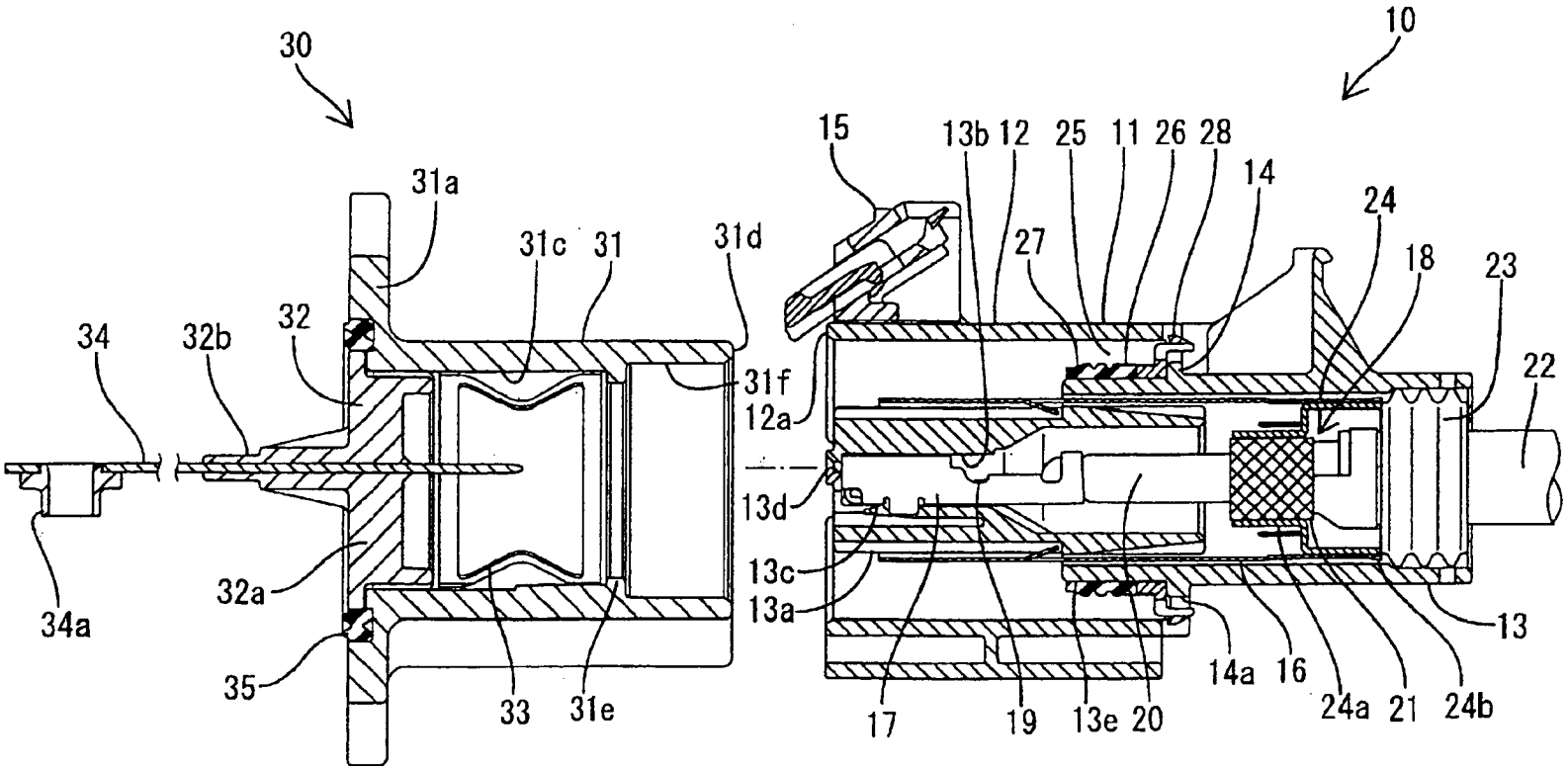
FIG. 4 is a sectional view taken along lines 4—4 of FIGS. 3 and 4.
Figure 5:
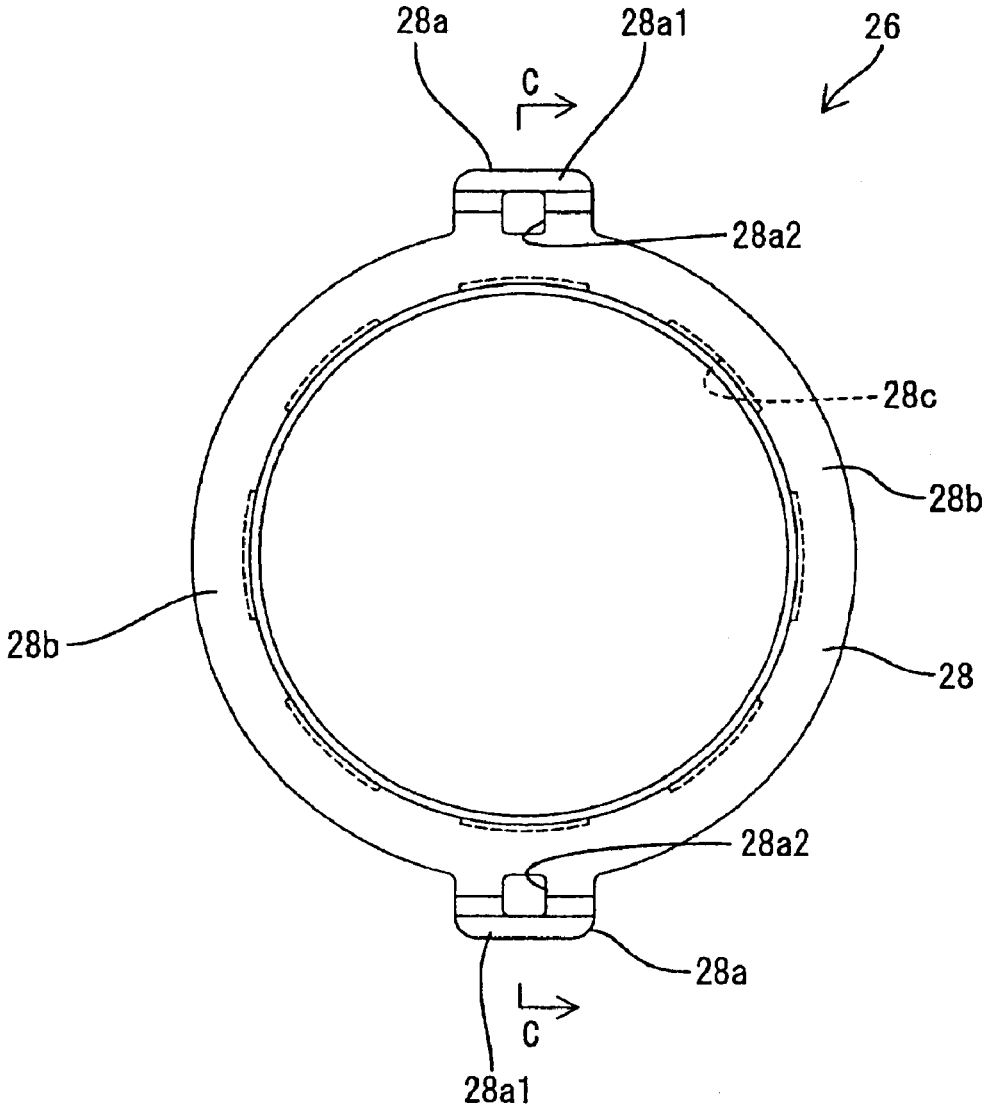
FIG. 5 is a rear view showing a sealing member.

As shown in FIG. 2, three cylindrical portions 13*a* are arranged inside the inner housing 13. The inner housing 13 and the outer housing 12 are connected to each other with an erect wall 14, as shown in FIG. 4. An engaging hole 14*a* is formed on the erect wall 14. A fit-on end surface 12*a* is formed at the front mating end of the outer housing 12. A gate-shaped lever 15 is connected to the outer housing 12. The lever 15 has a side plate 15*a* rotatably connected to a rotational shaft 12*b* formed at both side surfaces of the outer housing 12 and a bridge 15*b* connected to the side plates 15*a*. A cam groove (not shown) is formed on the side plates 15*a*.

A cylindrical shielding shell 16 made of a conductor is inserted into each cylindrical portion 13*a* of the inner housing 13. A female terminal fitting 17 is caulked to an end of a shielding electric wire 18 and is accommodated in a terminal fitting accommodation hole 13*b* of the cylindrical portion 13*a*. The female terminal fitting 17 engages a lance 13*c* near the front of the cylindrical portion 13*a*, and hence is prevented from slipping out of the terminal fitting accommodation hole 13*b*. An insertion hole 13*d* is formed at the front end of the cylindrical portion 13*a* and communicates with the terminal fitting accommodation hole 13*b*.

The shielding electric wire 18 has an electrically conductive core wire 19, and the core wire 19 is the portion of the shielding electric wire 18 to which the female terminal fitting 17 is caulked. An inner insulating layer 20 surrounds the core wire 19, and a shielding layer 21 made of braided narrow metal wires is formed on the outer peripheral surface of the inner insulating layer 20. An outer coating 22 surrounds the shielding layer 21. The shielding electric wire 18 is accommodated in the shielding shell 16.

The shielding electric wire 18 is inserted into a waterproof plug 23, and the waterproof plug 23 is mounted in the inner housing 13. The waterproof plug 23 is dimensioned and configured for sealed engagement with inner peripheral surface of the inner housing 13. A stepped sleeve 24 interposed between the shielding electric wire 18 and the shielding shell 16. The stepped sleeve 24 has a small-diameter portion 24*a* that is fit on the outer periphery of the shielding layer 21 and a large-diameter portion 24*b* that is in contact with the inner peripheral surface of the shielding shell 16. Therefore the shielding layer 21 and the stepped sleeve 24 define a shielding circuit between the shielding electric wire 18 and the shielding shell 16. A sealing member 26 is mounted on an outer peripheral portion 13*e* of the inner housing 13. A peripheral space 25 is formed between the sealing member 26 and the inner periphery of the outer housing 12.

The male connector 30 has a male housing 31 made of an electrically conductive aluminum die casting capable of shielding the inside of the male connector 30. A mounting flange 31*a* projects out from the rear end of the male housing 31, and a blocking plate 32 made of an insulating resinous material is mounted on rear end of the male housing 31 inwardly from the mounting flange 31*a*. Four mounting holes 31*b* extend through the mounting flange 31*a* and can receive bolts or the like to mount the male housing 31 to a motor housing (not shown) of an electric motor for an electric car.

Three louver accommodation holes 31*c* extend through the male housing 31 in a front-to-rear direction. A fit-on end surface 31*d* is formed at the front end of the louver accommodation hole 31*c*. A drum-shaped louver 33 made of an electrically conductive material is accommodated inside each louver accommodation hole 31*c*. The louver 33 contacts with the inner peripheral surface of the respective louver accommodation hole 31*c*. Additionally, the louver 33 contacts a rear face of an inwardly directed flange 31*e* formed inside the louver accommodation hole 31*c*. Thus, an axial position of the louver 31 is fixed.

Three circular blocks 32*a* are formed on the front face of the blocking plate 32 for retaining the louvers 33 in the louver accommodation holes 31*c* of the male housing 31. A projection 32*b* is formed on a rear face of each blocking portion 32*a*. Male terminal fittings 34 penetrate through the blocking portions 32*a* and the projected portions 32*b* for fixed mounting to the blocking plate 32. A motor terminal 34*a* is formed at the end of each male terminal fitting 34 and can be connected to a stator terminal (not shown) of the electric motor.

A loop-shaped waterproof ring 35 is interposed between the mounting flange 31*a* of the male housing 31 and the blocking plate 32 thereof. The waterproof ring 35 will contact the motor housing and display a sealing function when the male connector 30 is mounted on the electric motor. Thus, the waterproof ring 35 prevents water from penetrating into the male connector 30. A sealing surface 31*f* is formed on the inner periphery of the front side of the male housing 31. The sealing surface 31*f* contacts the outer periphery of the sealing member 26 when the female connector 10 and the male connector 30 are fit together. Two cam followers 31*g* are formed on outer side surfaces of the male housing 31. Each cam follower 31*g* engages a cam groove (not shown) on the side plate 15*a* of the lever 15 when the female and male connectors 10 and 30 are fit together. The lever 15 can be rotated and generates a cam action between the cam groove and the cam follower 31*g* for bringing the female and male connectors 10 and 30 closer together. Thus the connection between the female and male connectors 10 and 30 is completed.

Figure 6:
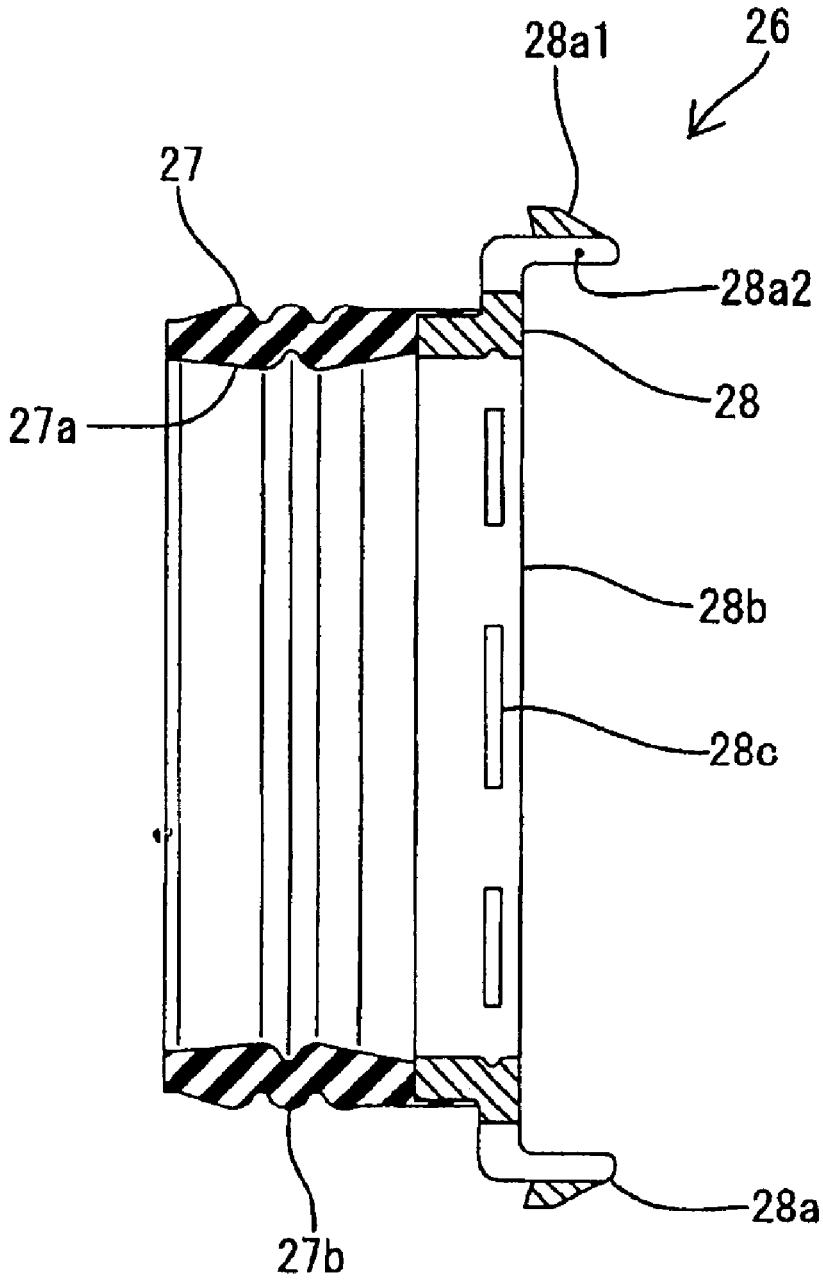
FIG. 6 is a sectional view taken along a line 6—6 of FIG. 5.

The sealing member 26 has a sealing part 27 made of a rubber material, such as a thermoplastic elastomer with low durometer hardness and silicone; and a rear part 28 fixed to the entire periphery of a rear end of the sealing part 27, as shown in FIG. 6. The rear part 28 is made of a rigid synthetic resin that has a rigidity higher than the rubber material of the sealing part 27, and may be formed from polypropylene polybutylene terephthalate (PBT), or polyamide, such as 6,6-Nylon. Inner peripheral lips 27*a* are formed on an inner periphery of the sealing part 27. The inner peripheral lips 27*a* are dimensioned and configured to sealingly engage the outer periphery 13*e* of the inner housing 13. Outer peripheral lips 27*b* are formed on the outer periphery of the sealing part 27. The outer peripheral lips 27*b* are dimensioned and configured to sealingly engage the inner peripheral sealing surface 31*f* of the male housing 31.

Locks 28*a* are formed at two diametrically opposed positions on the rear part 28. Each lock 28*a* projects radially outward. More particularly, each lock 28*a* has a locking claw 28*a*1 at a radially outer position for engaging the engaging hole 14*a* on the erect wall portion 14 of the female housing 11. The rear part 28 has a reinforcing portion 28*b* fixed to the entire periphery of the rear end of the sealing part 27 and connecting the two locks 28*a* to each other. The reinforcing portion 28*b* is formed integrally with the locks 28*a*. A slit 28*a*2 penetrates through each lock 28*a*. Concavities 28*c* are formed on an inner periphery of the rear part 28. The sealing member 26 is formed by using a two-color molding method or an over-molding method. Thus, the sealing part 27 made of the rubber material (e.g., thermoplastic elastomer or silicone) and the rear part 28 made of the synthetic resin (e.g., PBT or 6,6-Nylone) are fixed together to define an integral matrix of resin, but with two distinct sets of functions and characteristics for the sealing part 27 and the rear part 28.

The sealing member 26 is inserted into the outer housing 12 from the front side thereof and is mounted in sealing engagement with the outer periphery of 13*e* of the inner housing 13. At this time, the locking claw 28*a*1 engages the engaging hole 14*a* of the erect wall 14. The slit 28*a*2 on the locking portion 28*a* and the concavity 28*c* formed on the rear part 28 facilitate the inward elastic deformation of the locking portion 28*a* when the sealing member 26 is inserted into the outer housing 12.

The male connector 30 is mounted on the motor housing of the electric motor in advance. The fit-on end surface 12*a* formed on the outer housing 12 of the female connector 10 initially is fit on the fit-on end surface 31*d* on the male housing 31 of the male connector 30. Thus, the cam followers 31*g* of the male connector 30 engage the cam grooves (not shown) of the lever 15 on the female connector 10. The lever 15 then is rotated clockwise in FIG. 1 on the rotation shaft 12*b*, and the female connector 10 approaches the male connector 30 due to the cam action between the cam followers 31*g* and the cam grooves.

Figure 7:
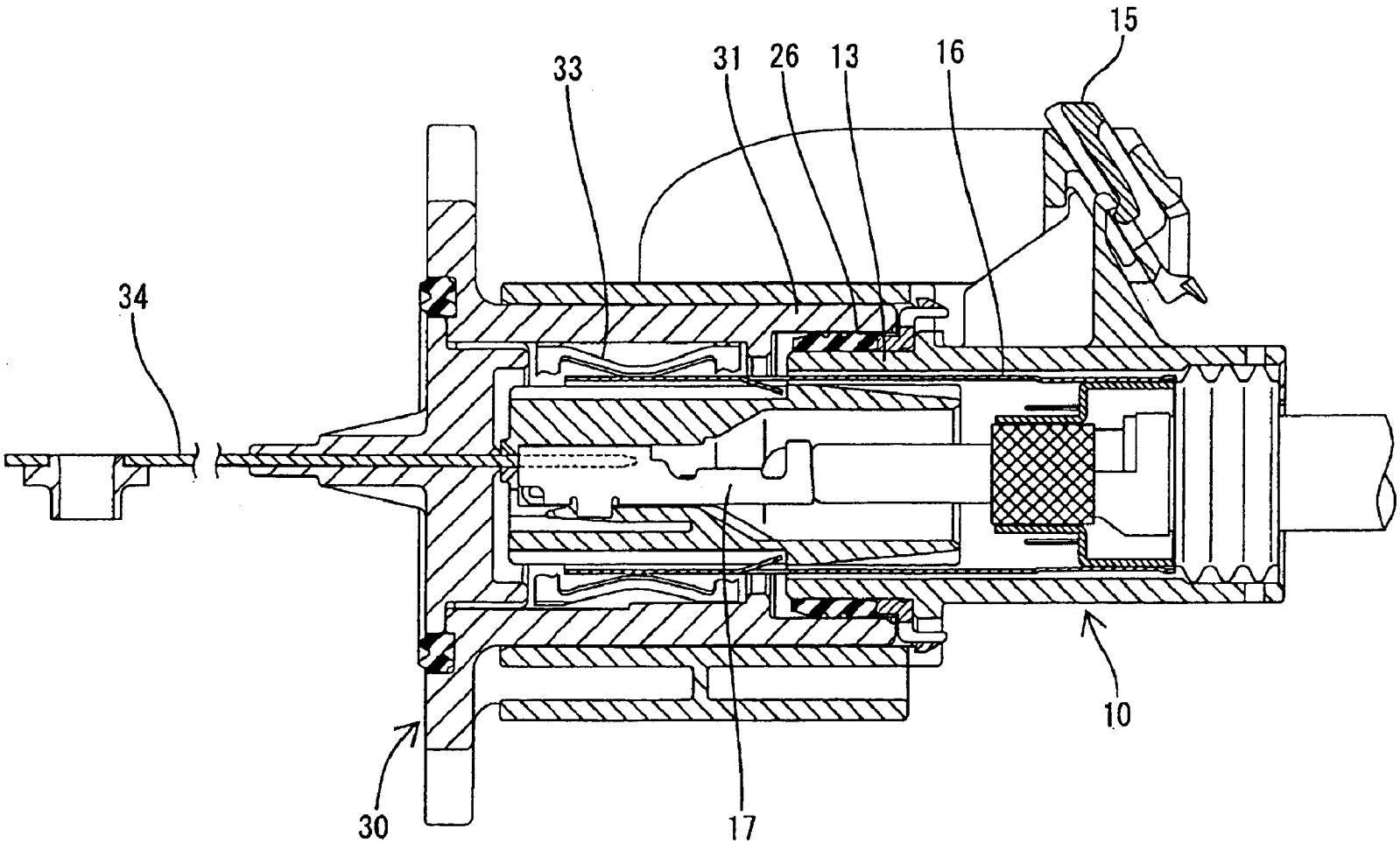
FIG. 7 is a sectional view showing a state in which the waterproof connector and the mating connector have been fitted on each other.

The male terminal fittings 34 pass through the insertion hole 13*d* of the female connector 10 and contact the female terminal fittings 17 as the female and male connectors 10 and 30 engage. At this time, the outer periphery of the shielding shell 16 of the female connector 10 contacts the inner periphery of the louver 33 of the male connector 30, thus expanding a sunken portion of the louver 33 outward. Therefore, a shielding circuit is formed from the shielding electric wire 18 to the electric motor through the shielding layer 21, the stepped sleeve 24, the shielding shell 16, the louver 33, and the male housing 31. The front end of the male housing 31 advances into the peripheral space 25 in the female connector 10, as shown in FIG. 7, when the female connector 30 is fit completely with the male connector 10. At this time, the sealing part 27 of the sealing member 26 is sandwiched under pressure between the inner peripheral sealing surface 31*f* of the male housing 31 and the outer periphery 13*e* of the inner housing 13, thus sealing the gap therebetween.

The female and male connectors 10 and 30 can be disconnected and separated from the state shown in FIG. 7, thereby causing the shielding shell 16 and the louver 33 to disengage. At this time, the fit-on end surface 31*d* of the male housing 31 moves rearward from the peripheral space 25 of the female connector 10. As a result, the inner peripheral sealing surface 31*f* of the male housing 31 and the sealing part 27 also disengage from each other. The sealing part 27 is made of the rubber material and sticks to the aluminum die cast male housing 31. However, the locking claw 28*a*1 of the lock 28*a* is in engaged in the engaging hole 14*a* of the erect wall 14. Thus the sealing member 26 is held by the female housing 11.

The lock 28*a* of the sealing member 26 is made of the highly rigid synthetic resin. Thus the lock 28*a* is not expanded or broken when the sealing part 27 is subjected to a pulling force applied by the male housing 31 as the female connector 10 is disengaged from the male connector 30. Thus the sealing member 26 will not slip off the female housing 11. The reinforcing portion 28*b* is integral with the locking portion 28*a* and is fixed to the entire periphery of the rear end of the sealing part 27. Thus, the entire periphery of the sealing part 27 is held by the female housing 11. Therefore, the sealing part 27 will not slip off the female housing 11 can be prevented in response to a pulling force applied by the male housing 31.

The reinforcing portion 28*b* is integral with the lock 28*a* and is fixed to the entire periphery of the rear end of the sealing part 27. Thus, a molding die for the sealing member 26 has a comparatively simple construction and can be produced easily. The sealing part 27 and the rear part 28 are formed by a two-color molding method. Thus it is possible to fix the sealing part 27 made of the rubber and the rear part 28 made of the synthetic resin to each other easily in one process and there is no need to bond them together. Thus the sealing member 26 can be manufactured at a low cost.

Figure 8:
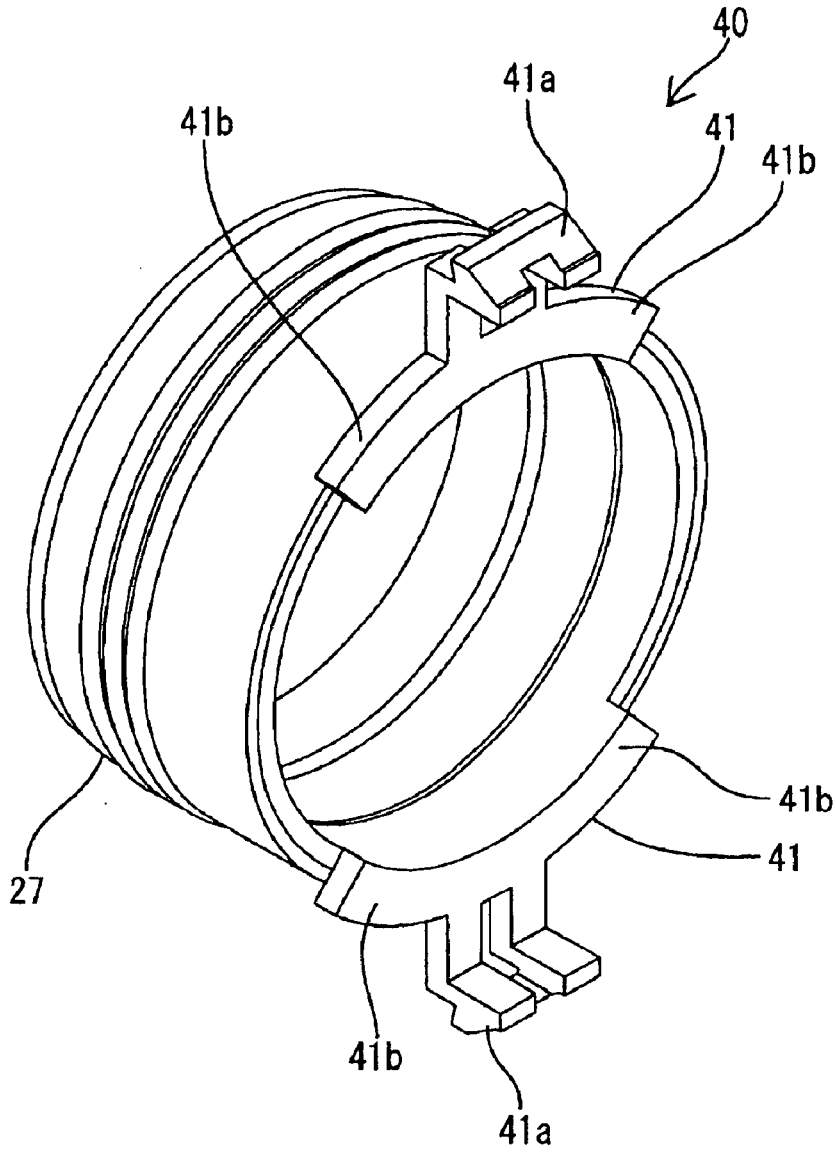
FIG. 8 is a perspective view showing a sealing member of a second embodiment of the present invention.

A sealing member 40 of a second embodiment of the invention is shown in FIG. 8. The sealing member 40 is different from the sealing member 26 of the first embodiment only in the construction of a rear part 41 thereof. More particularly, a reinforcing portion 41*b* is fixed to the rear end of the sealing part 27, but is integral only with both sides of each of two locks 41*a*. Furthermore, the reinforcing portion 41*b* is formed only in the vicinity of both sides of each of the two locks 41*a*. Thus, a portion of the locking portion 41*a* near both sides of each of the lock 41*a* can be held by the female housing 11. Further it is possible to save the cost of the material for the rear part 41 and make the sealing member 40 light. As in the case of the sealing member 26, the sealing member 40 can be formed by using the two-color molding method. Therefore the sealing part 27 and the rear part 41 can be fixed to each other easily in one process. Thus the sealing member 40 can be manufactured easily at a low cost.

The invention is not limited to the embodiment described above with reference to the drawings. For example, the following embodiments are included in the technical scope of the invention. Further, various modifications can be made without departing from the spirit and scope of the present invention.

The locking portion or the reinforcing portion of the sealing member does not necessarily have to be made of a synthetic resin, but may be made of a highly rigid material such as metal, ceramics and the like.

In addition to the two-color molding method, the sealing part and the rear part can be fixed to each other with an adhesive agent, vulcanization, insert molding, and mechanical connection methods.

The locking portion does not necessarily have to be locked to the connector housing by the locking claw, but by locking means having various configurations.

The sealing member does not necessarily have to be ring-shaped, but the present invention is applicable to loop-shaped sealing members.

The invention is described for a shielding connector but also is applicable to connectors of various types.

The sealing member of the present invention is applicable to both female and male connectors.

What is claimed is:

1. A waterproof connector comprising:

a housing having an engaging hole formed therein;

a mating housing connectable with the housing; and a loop-shaped sealing member including a sealing part formed from an elastomer, the sealing part being mounted on the housing and sealed elastically between said housing and said mating housing and a lock formed from a rigid resin material and having a reinforcing portion molded integrally with said sealing part such that said sealing part and said reinforcing portion of said lock defines a continuous matrix of elastomeric and rigid resin materials, said lock further including a locking claw unitary with the reinforcing portion and locked to the engaging hole on said housing for preventing said sealing part from slipping off said housing.

2. The waterproof connector of claim 1, wherein the reinforcing portion is at both sides of said locking claw in a circumferential direction thereof.

3. The waterproof connector of claim 2, wherein said reinforcing portion is fixed to an entire periphery of a rear end of said sealing part.

4. The waterproof connector of claim 2, wherein said lock is fixed to said sealing part by using a two-color molding method.

5. The waterproof connector of claim 1, wherein the mating housing is formed from a cast metal.

6. The waterproof connector of claim 5, wherein the mating housing is formed from cast aluminum.

7. The waterproof connector of claim 1, wherein the lock includes a slit for facilitating deflection during mounting the sealing member on the housing.

8. A waterproof connector, comprising:

a housing having outer and inner housings connected to one another by a wall, the wall being formed with a plurality of engaging holes formed therethrough;

a mating housing formed from a metal material and being connectable with the housing between the outer and inner housings; and a loop-shaped sealing member including an annular rubber sealing part and sealed elastically between said inner housing and in inner surface of said mating housing and a rear part formed from a rigid synthetic resin and molded integrally with the rubber sealing part such that the rear part and said rubber sealing part define a continuous matrix of rubber and resin materials, the rear part including at least one lock locked to the engaging hole on said housing for preventing said sealing part from slipping off said inner housing.

9. The waterproof connector of claim 8, wherein the rear part is integral with annular the rubber sealing part entirely around an annular periphery of the annular rubber sealing part.

10. The waterproof connector of claim 8, wherein the rear part is integral with the annular rubber sealing part at two diametrically spaced arc-shaped reinforcing parts on the annular rubber sealing part.

11. The waterproof connector of claim 8, wherein the mating housing is formed from cast aluminum.

12. The waterproof connector of claim 8, wherein the lock includes a slit for facilitate deflection during mounting the sealing member on the housing.

* * * * *